US010217408B2

(12) United States Patent
Tsuchida

(10) Patent No.: US 10,217,408 B2
(45) Date of Patent: Feb. 26, 2019

(54) DISPLAY DEVICE, DISPLAY DEVICE CORRECTION METHOD, DISPLAY DEVICE MANUFACTURING METHOD, AND DISPLAY DEVICE DISPLAY METHOD

(71) Applicant: JOLED INC., Tokyo (JP)

(72) Inventor: Shinya Tsuchida, Tokyo (JP)

(73) Assignee: JOLED INC., Tokyo (JP)

( * ) Notice: Subject to any disclaimer, the term of this patent is extended or adjusted under 35 U.S.C. 154(b) by 141 days.

(21) Appl. No.: 15/347,877

(22) Filed: Nov. 10, 2016

(65) Prior Publication Data

US 2017/0132972 A1 May 11, 2017

(30) Foreign Application Priority Data

Nov. 11, 2015 (JP) ..... 2015-221341
Sep. 6, 2016 (JP) ..... 2016-174069

(51) Int. Cl.
*G09G 3/3233* (2016.01)

(52) U.S. Cl.
CPC ... *G09G 3/3233* (2013.01); *G09G 2300/0842* (2013.01); *G09G 2320/0285* (2013.01); *G09G 2320/043* (2013.01)

(58) Field of Classification Search
CPC ..... G09G 2320/0233; G09G 2320/045; G09G 2320/0626
USPC ..... 345/76–81
See application file for complete search history.

(56) References Cited

U.S. PATENT DOCUMENTS 9,208,721 B2 12/2015 Odawara et al.
2004/0227697 A1* 11/2004 Mori ..... G09G 3/20 345/30
2007/0091041 A1 4/2007 Chung et al.
2009/0184984 A1* 7/2009 Takahara ..... G09G 3/2014 345/690
2013/0021389 A1 1/2013 Odawara et al.
2017/0148370 A1* 5/2017 Nakamura ..... G09G 3/2044

FOREIGN PATENT DOCUMENTS

KR 10-2007-0044711 4/2007
WO 2011/118124 9/2011

OTHER PUBLICATIONS

Office Action, dated Jun. 12, 2018, in the corresponding Korean Patent Application No. 10-2016-0149547.

* cited by examiner

*Primary Examiner* — Roy P Rabindranath
(74) *Attorney, Agent, or Firm* — Greenblum & Bernstein, P.L.C.

(57) ABSTRACT

A method of correcting a display device, including pixels that are arranged in a matrix and have light-emitting elements that emit light according to a luminance signal, is provided. The method includes obtaining in advance first correction data, which includes correction data components each corresponding to a different one of the pixels and is for correcting the luminance signal. The method also includes transforming the first correction data into second correction data, by (i) reconfiguring the correction data components by propagating an error component of each of the correction data components to surrounding pixels of a corresponding one of the pixels, and (ii) performing bit reduction on the correction data components that have been reconfigured. The method further includes correcting the luminance signal using the second correction data.

5 Claims, 12 Drawing Sheets

DISPLAY DEVICE, DISPLAY DEVICE CORRECTION METHOD, DISPLAY DEVICE MANUFACTURING METHOD, AND DISPLAY DEVICE DISPLAY METHOD

CROSS REFERENCE TO RELATED APPLICATION

The present application is based on and claims priority of Japanese Patent Application No. 2016-174069 filed on Sep. 6, 2016 and Japanese Patent Application No. 2015-221341 filed on Nov. 11, 2015. The entire disclosures of the above-identified applications, including the specifications, drawings and claims are incorporated herein by reference in their entirety.

FIELD

The present disclosure relates to a display device, a display device correction method, a display device manufacturing method, and a display device display method.

BACKGROUND

Organic electroluminescent (EL) displays are known as display devices that use current-driven light-emitting elements. Due to such advantages as having excellent viewing angle characteristics and low power consumption, organic EL displays have gained much attention.

In organic EL display devices, organic EL elements included in pixels are normally arranged in a matrix. In particular, in an active-matrix organic EL display, it is possible to cause an organic EL element to emit light until the next scanning (selection), and thus display luminance does not decrease even if duty ratio increases. Therefore, since driving with low voltage is possible, reduction of power consumption becomes possible. Unfortunately, in the active-matrix organic EL display device, due to variation in the characteristics of the drive transistors and organic EL elements, the luminance of the organic EL elements are different among the respective pixels even when the same luminance signal is supplied, and thus there is the disadvantage of the occurrence of what is called luminance unevenness.

As a method of correcting luminance unevenness in a conventional organic EL display, a method which compensates for non-uniformity of characteristics of each pixel by correcting the luminance signal using correction data stored in advance in a memory.

For example, Patent Literature (PTL) 1 discloses an organic EL display device manufacturing method used in a display panel having pixels each including an organic EL element and a drive transistor. The organic EL display device manufacturing method includes obtaining the representative current-voltage characteristic, the luminance-current characteristic of respective segment regions, and the luminance-voltage characteristic of the respective pixels, and obtaining, for each pixel, correction data by which the current-voltage characteristic of the respective pixels obtained from the obtained characteristics can be made to equal the representative current-voltage characteristic. Accordingly, highly-accurate correction data can be obtained, and thus non-uniformity of luminance within the display panel is remedied, and unevenness in luminance deterioration attributed to service life can be suppressed.

CITATION LIST

Patent Literature

[PTL 1] International Publication No. WO2011/118124

SUMMARY

Technical Problem

Unfortunately, in the organic EL display device disclosed in PTL 1, the correction data (gain and offset) for each pixel calculated in advance is stored in a memory in a control circuit. As such, increasing display panel resolution while ensuring highly-accurate correction data becomes problematic in that the amount of correction data becomes enormous and data transfer rate for luminance signals, etc. becomes strained. This is particularly problematic in the case of tablet terminals for which miniaturization and heightened definition are demanded.

The present invention provides a display device, a display device correction method, a display device manufacturing method, and a display device display method which reduce correction data volume and transfer rate while ensuring correction accuracy.

Solution to Problem

A display device correction method according to an aspect of the present invention is a display device correction method for correcting luminance unevenness in a display device including pixels which are arranged in a matrix and have light-emitting elements that emit light according to a luminance signal. The display device correction method includes: obtaining in advance first correction data which includes correction data components each corresponding to a different one of the pixels and is for correcting the luminance signal; transforming the first correction data into second correction data by (i) reconfiguring the correction data components by propagating an error component of each of the correction data components to surrounding pixels of a corresponding one of the pixels and (ii) performing bit reduction on the correction data components that have been reconfigured; and correcting the luminance signal using the second correction data.

Furthermore, a display device manufacturing method according to an aspect of the present invention is a display device manufacturing method for manufacturing a display device including pixels which are arranged in a matrix and have light-emitting elements that emit light according to a luminance signal. The display device manufacturing method includes: forming a display panel in which the pixels are arranged; obtaining in advance first correction data which includes correction data components each corresponding to a different one of the pixels and is for correcting the luminance signal; transforming the first correction data into second correction data by (i) reconfiguring the correction data components by propagating an error component of each of the correction data components to surrounding pixels of a corresponding one of the pixels and (ii) performing bit reduction on the correction data components that have been reconfigured; and storing the second correction data in a memory included in the display device after the transforming.

Furthermore, a display device display method according to an aspect of the present invention is a display device display method for a display device including pixels that are arranged in a matrix and have light-emitting elements that emit light according to a luminance signal. The display device display method includes: correcting the luminance signal using second correction data obtained by obtaining in advance first correction data which includes correction data components each corresponding to a different one of the pixels and is for correcting the luminance signal, and transforming the first correction data into the second correction data by (i) reconfiguring the correction data components by propagating an error component of each of the correction data components to surrounding pixels of a corresponding one of the pixels and (ii) performing bit reduction on the correction data components that have been reconfigured; and displaying on the display device by supplying the luminance signal corrected in the correcting to the pixels to cause the light-emitting elements to emit light according to the luminance signal.

Furthermore, a display device according to an aspect of the present invention is a display device including pixels which are arranged in a matrix and include light-emitting elements that emit light according to a luminance signal, the display device includes: a transformer that transforms first correction data, which includes correction data components each corresponding to a different one of the pixels and is for correcting the luminance signal, into second correction data by (i) reconfiguring the correction data components by propagating an error component of each of the correction data components to surrounding pixels of a corresponding one of the pixels and (ii) performing bit reduction on the correction data components that have been reconfigured; and a corrector that corrects the luminance signal using the second correction data.

Advantageous Effects

According to a display device, a display device correction method, a display device manufacturing method, and a display device display method according to one or more aspects of the present invention, the luminance signal is corrected using correction data obtained by propagating the error component of each of the correction data components to surrounding pixels and then performing bit reduction on the correction data component, and thus correction data volume and transfer rate can be reduced while ensuring correction accuracy.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

Figure 1:
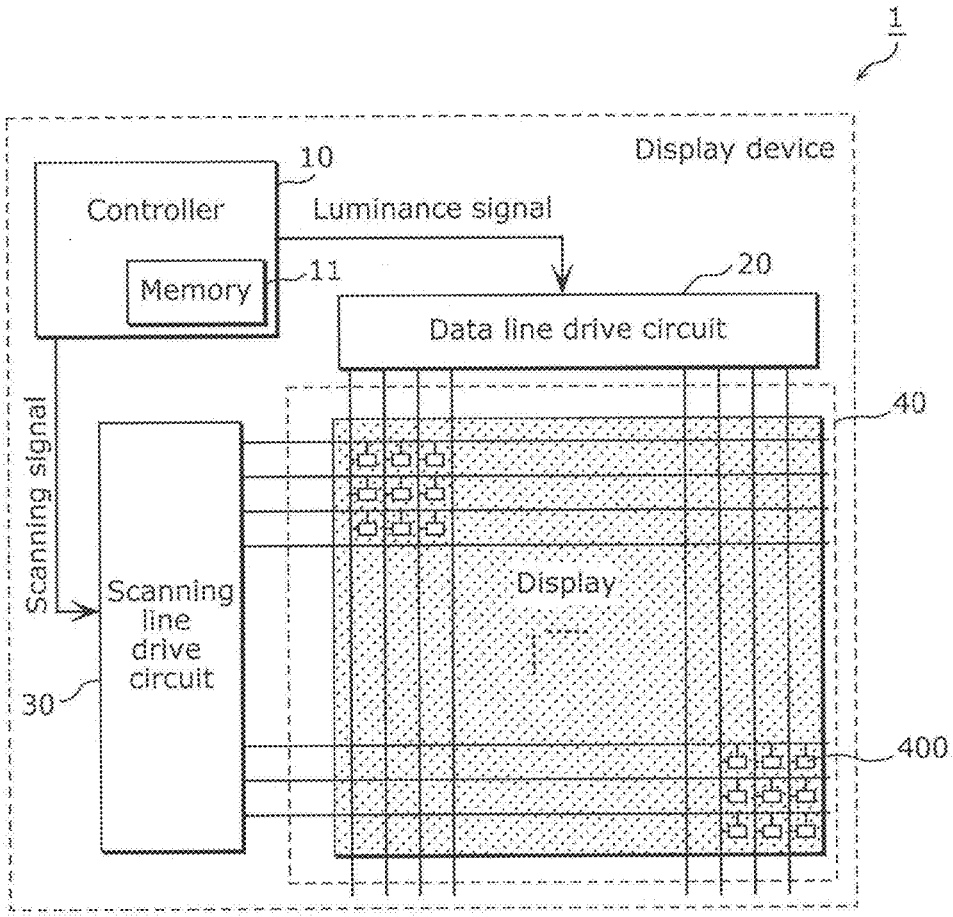
FIG. 1 is a block diagram showing a configuration of the display device according to Embodiment 1.

Hereinafter, exemplary embodiments will be described in detail with reference to the drawings. It should be noted that elements that are the same or equivalent in the drawings are assigned the same reference signs and overlapping descriptions will be omitted.

It should be noted that each of the exemplary embodiments described below represent a specific example of the present invention. The numerical values, shapes, materials, structural elements, the arrangement and connection of the structural elements, steps, the processing order of the steps, etc. shown in the following exemplary embodiments are mere examples, and therefore do not limit the scope of the present invention. The present invention is determined by the appended claims. Thus, among the structural elements in the following exemplary embodiments, structural elements not recited in any one of the independent claims which indicate the broadest concepts of the present invention are described as arbitrary structural elements.

Embodiment 1

[1.1 Configuration of Display Device]

FIG. 1 is a block diagram illustrating a configuration of a display device 1 according to Embodiment 1. The display device 1 in the figure includes a controller 10, a data line drive circuit 20, a scanning line drive circuit 30, and a display 40. The controller 10 includes a memory 11. It should be noted that the memory 11 may be disposed inside of the display device 1 and outside of the controller 10.

The controller 10 controls the memory 11, the data line drive circuit 20, and the scanning line drive circuit 30. For example, the post-processing correction data (second correction data to be described later) is stored in the memory 11 at the completion of the manufacturing stage of the display apparatus 1.

During display operation, the controller 10 reads the second correction data that has been written into the memory 11, and corrects a video signal (luminance signal) inputted from the outside based on the second correction data, and outputs the result to the data line drive circuit 20.

Furthermore, for example, when pre-processing correction data is generated in the manufacturing stage, the controller 10 communicates with an external information processing apparatus, for example, to thereby drive the data line drive circuit 20 and the scanning line drive circuit 30 according to the information processing apparatus.

Furthermore, the controller 10, for example, performs transformation processing of the pre-processing correction data (first correction data) to generate the post-processing correction data (second correction data), and stores the post-processing correction data in the memory 11.

The display 40 includes a plurality of pixels 400 which are arranged in a matrix, and displays an image based on the video signal (luminance signal) inputted to the display device 1 from the outside.

Figure 2:
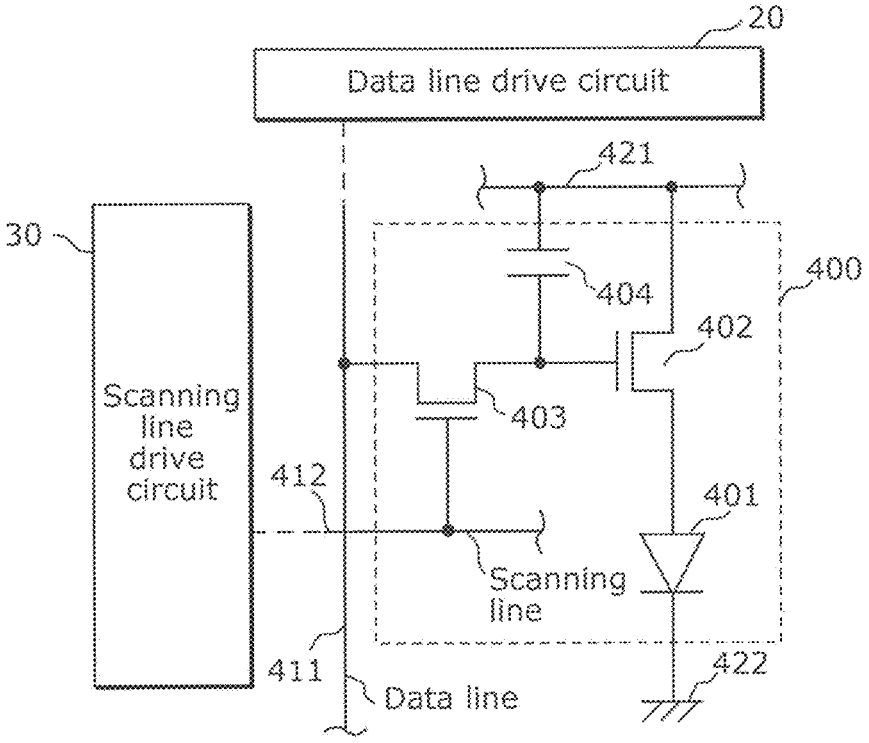
FIG. 2 is a diagram illustrating an example of the circuit configuration of a pixel and the connection with peripheral circuits, according to Embodiment 1.

FIG. 2 is a diagram illustrating an example of the circuit configuration of a pixel 400 and the connection with peripheral circuits, according to Embodiment 1. The pixel 400 in the figure includes a scanning line 412, a data line 411, a power supply line 421, a selection transistor 403, a drive transistor 402, an organic EL element 401, a holding capacitor element 404, and a common electrode 422. Furthermore, the peripheral circuits include the data line drive circuit 20 and the scanning line drive circuit 30.

The scanning line drive circuit 30 is connected to the scanning line 412, and controls conduction and non-conduction of the selection transistor 403 of the pixel 400.

The data line drive circuit 20 is connected to the data line 411, and has a function of outputting a data voltage which is the luminance signal that has been corrected using the second correction data, to determine the signal current that flows through the drive transistor 402.

The selection transistor 403 has a gate terminal connected to the scanning line 412, and controls the timing for supplying the data voltage of the data line 411 to the gate terminal of the drive transistor 402.

The drive transistor 402 has a gate terminal connected to the data line 411 via the selection transistor 403, a source terminal connected to the anode terminal of the organic EL element 401, and a drain terminal connected to the power supply line 421. Accordingly, the drive transistor 402 converts the data voltage supplied to its gate terminal into a signal current corresponding to the data voltage, and supplies the signal current obtained from the conversion to the organic EL element 401.

The organic EL element 401 functions as a light-emitting element, and the cathode terminal of the organic EL element 401 is connected to the common electrode 422.

The holding capacitor element 404 is connected between the power supply line 421 and the gate terminal of the drive transistor 402. The holding capacitor element 404, for example, maintains the immediately preceding gate current even after the selection transistor 403 is placed in the OFF state, and is capable causing a drive current to be continuously supplied from the drive transistor 402 to the organic EL element 401.

It should be noted that, although not illustrated in FIG. 1 and FIG. 2, the power supply line 421 is connected to a power supply. Furthermore, the common electrode 422 is also connected to a power supply.

The data voltage supplied from the data line drive circuit 20 is applied to the gate terminal of the drive transistor 402 via the selection transistor 403. The drive transistor 402 passes, across the source and drain terminals, current that is in accordance with the data voltage. When this current flows to the organic EL element 401, the organic EL element 401 emits light at a light-emission luminance that is in accordance with the current.

It should be noted that in the circuit configuration of the pixel 400 illustrated in FIG. 2, other circuit elements and wiring may be inserted between the paths connecting the respective circuit elements.

[1.2 Configuration of Controller]

Figure 3:
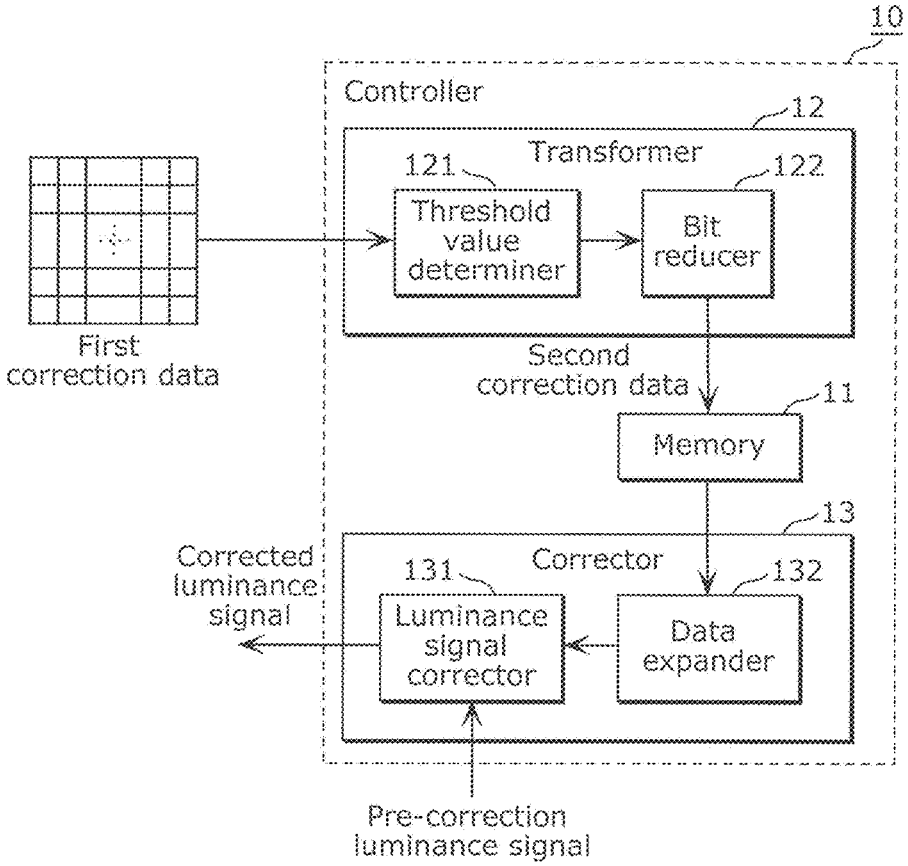
FIG. 3 is a block diagram illustrating the configuration of a controller included in the display device according to Embodiment 1.

FIG. 3 is a block diagram illustrating the configuration of the controller 10 included in the display device 1 according to Embodiment 1. The controller 10 illustrated in the figure includes the memory 11, a transformer 12, and a corrector 13.

The controller 12 transforms pre-processing correction data (first correction data) including the correction data components of each pixel into second correction data by (i) reconfiguring the correction data component of the pixel by propagating, to the surrounding pixels of the pixel, the error component generated when the correction data component corresponding to the pixel is quantized, and (ii) bit-reducing the reconfigured correction data component of the pixel.

The corrector 13 corrects the luminance signal using the second correction data. The luminance signal is an electrical signal that is applied to a pixel to cause the light-emitting signal of the pixel to emit light. More specifically, in this embodiment, the luminance signal refers to the data voltage applied from the data line drive circuit 20 to the gate of the drive transistor 402 in order to cause the organic element 401 included in pixel 400 to emit light.

Here, the pre-processing correction data (first correction data) will be described. The first correction data is, for example, data for reducing luminance unevenness when each of the pixels 400 of the display 40 emit light based on the video signal transmitted to display device 1 from the outside. More specifically, the correction data, for example, includes two correction parameters, a gain correction value and an offset correction value, that are made to correspond to the pixel 400. It should be noted that the correction data need not correspond to the pixel 400, and may correspond to each of pixel groups which is a collective body of adjacent pixels.

Figure 4:
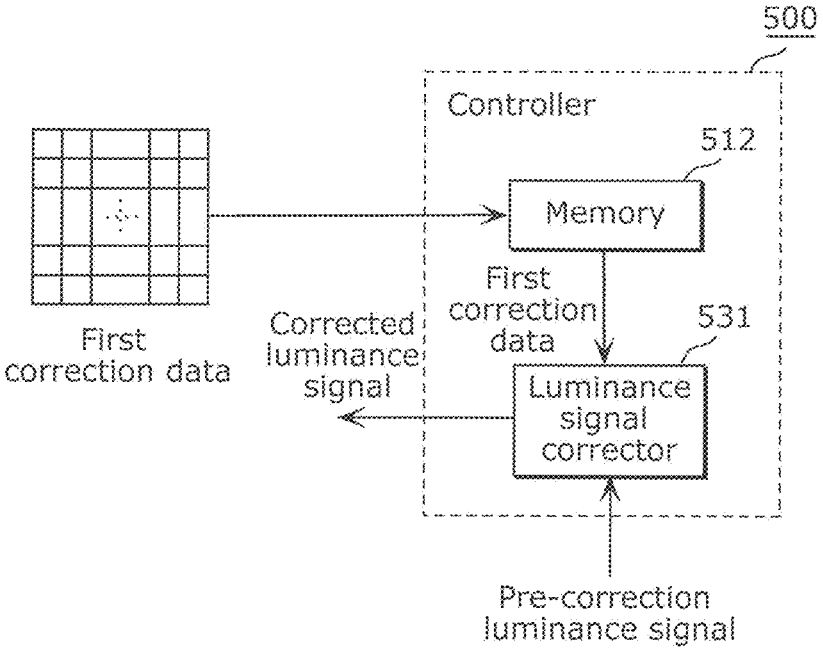
FIG. 4 is a block diagram illustrating the configuration of a controller included in a conventional display device.

FIG. 4 is a block diagram illustrating the configuration of a controller 500 included in a conventional display device. The conventional controller 500 illustrated in the figure includes a memory 512 and a luminance signal corrector 531. In the conventional display device, the controller 500 stores, in advance, first correction data in the memory 512. Furthermore, controller 500 converts a video signal to generate a luminance signal (pre-correction luminance signal) for each pixel. The luminance signal corrector 531 corrects the pre-correction luminance signal by reading the first correction data from the memory 512, multiplying (or dividing) the pre-correction luminance signal by the gain correction value of the first correction data, and adding (or subtracting) the offset correction value of the first correction data to the product. The controller 500 outputs the corrected luminance signal obtained in the above-described manner, to the data line drive circuit at a predetermined timing. With this, luminance unevenness in the display unit is reduced.

In the conventional display device, there is the problem that, as the resolution of the display increases, the amount of correction data to be stored in the memory 512 becomes enormous and the data transmission rate for the luminance signal, etc., rises and becomes strained. In particular, in a tablet terminal for which miniaturization and heightened definition is demanded, securing a large-capacity memory is difficult, and leads to increased cost.

In contrast, in the display device 1 according to this embodiment, the luminance signal is corrected, not by using the aforementioned first correction data (pre-processing correction data), but by using the post-processing correction data (second correction data) obtained by performing volume-reduction on the pre-processing correction data (first correction data). Hereinafter, the configuration for generating the second correction data from the first correction data in the display device 1 according to this embodiment will be described.

The transformer 12 includes a threshold value determiner 121 and a bit reducer 122. The transformer 12 transforms first correction data into second correction data by (i) reconfiguring the correction data component of each pixel included in the first correction data, by propagating, to the surrounding pixels of the pixel, the error component of the correction data component of the pixel included in the first correction data, and (ii) performing bit reduction on the reconstructed correction data components of the first correction data.

The threshold value determiner 121 determines the threshold value to be used in the bit reduction by the subsequently-connected bit reducer 122, based on the distribution of correction data components included in the first correction data.

The bit reducer 122 quantizes the correction data component of each pixel included in the first correction data, based on the threshold value determined by the threshold value determiner 121, reconfigures the correction data component of each pixel included in the first correction data by propagating the error component generated in the quantization to the surrounding pixels of the pixel, and performs bit-reduction on the reconfigured correction data components of the first correction data to generate second correction data. More specifically, the bit reducer 122 bit-reduces the correction data component of each pixel included in the first correction data to a correction data component having a number of bits that is smaller than the number of bits of the correction data component before bit reduction, based on the threshold value.

It should be noted that the bit reducer 122 may binarize (convert to "0" or "1") the reconfigured correction data component of the first correction data, based on the threshold value determined by the threshold value determiner 121. In this case, the correction data can be volume-minimized.

Error diffusion, for example, is used as a quantization method for reconfiguring the correction data component of each pixel included in the first correction data by propagating, to the surrounding pixels of the pixel, the error component of the correction data component of the pixel included in the first correction data. Aside from error diffusion, dithering, represented by random dithering and pattern dithering, etc. may be applied as the aforementioned method. By using error diffusion as the processing performed by the bit reducer 122, luminance signal correction accuracy can be ensured.

The memory 11 stores the second correction data generated as a result of the transformation of the first correction data by the transformer 12. Because the second correction data results from the bit reduction of the first correction data, the second correction data has a smaller volume than the first correction data. As the resolution of the display 40 increases, the effect of reducing the capacity of the memory 11 for storing the second correction data that has been volume-reduced by the transformer 12 becomes prominent. From the point of view of a recording medium that does not require excessively large capacity and long service life, a nonvolatile memory such as a flash memory can be applied as the memory 11.

The corrector 13 includes a data expander 132 and a luminance signal corrector 131.

The data expander 132 includes, for example, a nonvolatile first memory such as a DRAM, and an operation circuit. The data expander 132 reads the second correction data from the memory 11 and temporarily stores the second correction data in the first memory. Here, at least one of threshold value determined by the threshold value determiner 121 and a discrete value from the quantization of the first correction data is stored in a second memory, represented by a SRAM, provided inside (or outside) the first memory. The operation circuit may expand the second correction data stored in the first memory to correction data (discrete value) having a larger number of bits than the number of bits of the second correction data stored in the memory 11, using the at least one of the threshold value determined by the threshold value determiner 121 and a discrete value from the quantization of the first correction data that is stored in the second memory. In other words, the corrector 13 expands the second correction data to data with a larger number of bits than the second correction data, using the at least one of the threshold value and the discrete value, and correcting the luminance signal using the correction data obtained by bit-compressing the first correction data. It should be noted that in the controller 10 according to this embodiment, the data expander 132 is not an essential structural component.

However, since the correction accuracy of the second correction data deteriorates as the bit reduction rate for the first correction data of the bit reducer 122 increases, the data expander 132 may be provided in the case where the bit reduction rate is high.

The luminance signal corrector 131 corrects the luminance signal corresponding to the pixel 400 using the second correction data expanded by the data expander 132. An example of the luminance signal correction by the luminance signal corrector 131 is shown below.

Out of the second correction data (gain correction value, offset correction value), the luminance signal corrector 131 multiplies (or divides) the data voltage corresponding to the pre-correction luminance signal by the gain correction value, and adds (or subtracts) the offset correction value to the product, and outputs the result to the data line drive circuit 20. With this, it becomes possible to reduce correction data volume and transfer rate while ensuring luminance correction accuracy.

Here, the specific processing performed by transformer 12 will be described in detail using FIG. 5.

Figure 5:
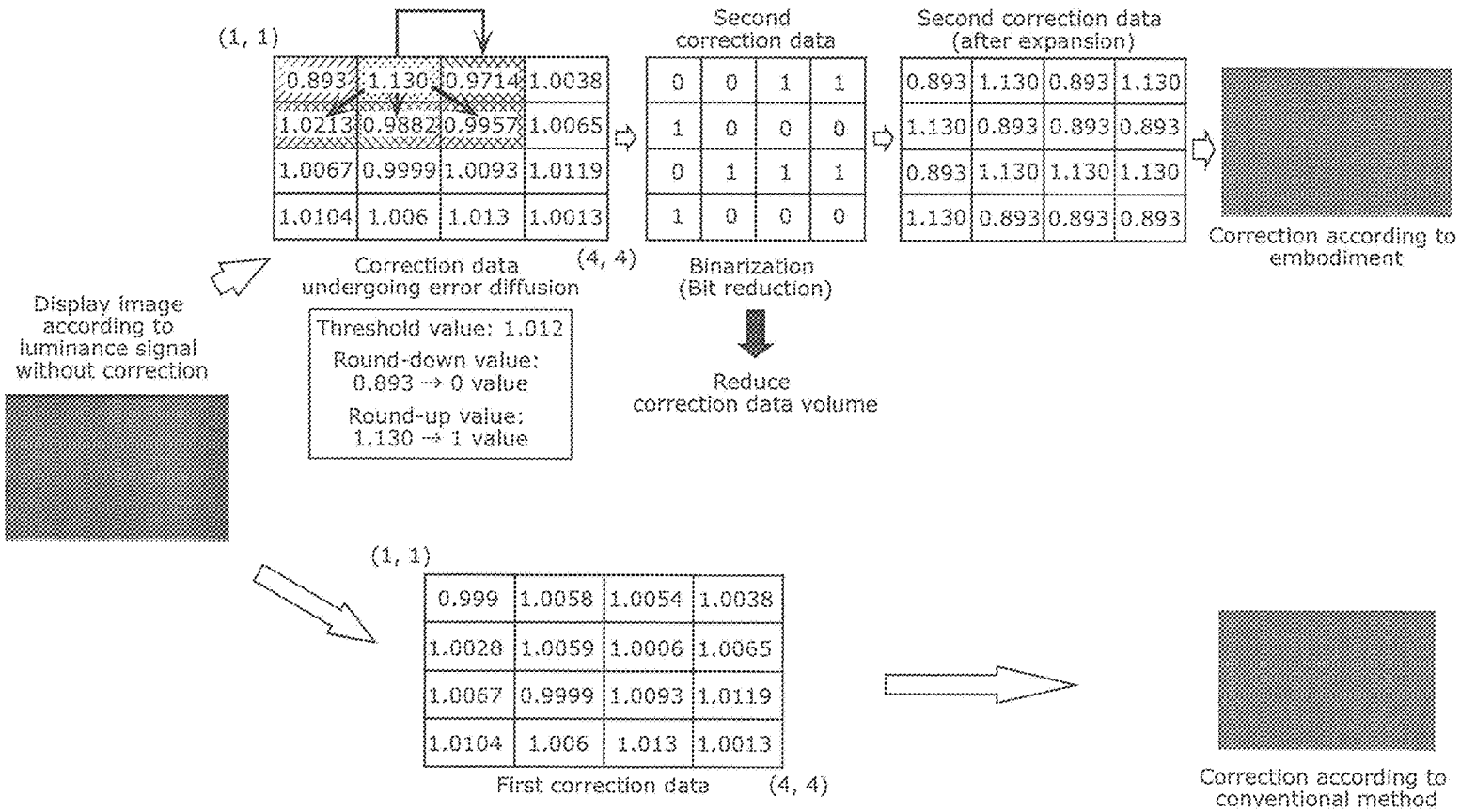
FIG. 5 is a diagram comparing the correction processing performed by the display device according to Embodiment 1 and the conventional display device and the results thereof.

FIG. 5 is a diagram comparing the correction processing performed by the display device 1 according to Embodiment 1 and the conventional display device and the results thereof. The display image illustrated on the left side of the figure is an example of an image in the case where the display displays according to non-corrected luminance signal when the entire display is caused to emit light at the same luminance. In contrast, the display image illustrated in the upper right of FIG. 5 is an image in the case where the display displays according to a corrected luminance signal that has been processed by the corrector 10 of the display device 1 according to this embodiment. Furthermore, the display image illustrated in the lower right of FIG. 5 is an image in the case where the display displays according to the corrected signal processed by the controller 500 of the conventional display device.

Furthermore, the display image by display device 1 according to this embodiment has been corrected using the second correction data generated through the error diffusion and the bit reduction performed by the transformer 12. In the first correction data illustrated in FIG. 5, the gain correction values (correction data components) of the respective pixels, for example, are represented in a matrix. In the display device 1 according to this embodiment, error diffusion is to be performed on the first correction data. This will be described below using the correction data undergoing error diffusion, illustrated in FIG. 5. It should be noted that, for convenience of explanation, in FIG. 5, the correction data undergoing error diffusion is represented as being composed of 4 rows×4 columns of correction data components, and a correction data component is expressed as "(row, column)". For example, the top leftmost correction data component is denoted as (1, 1), and the bottom rightmost correction data component is denoted as (4, 4).

First, as an error diffusion pre-processing stage, the threshold value determiner 121 determines, from the distribution state of each correction data component of the first correction data, the threshold value (=1.012), the round-down value (=0.893), and the round-up value (=1.130). Here, each of the round-down value and the round-up value is a discrete value obtained from the quantization of (the correction data components of) the first correction data.

Next, the bit reducer 122 compares the correction data component (1, 1) of the first correction data and the threshold value (0.999<1.012), and replaces the correction data component (1, 1) after error diffusion with the round-down value (0.893) which is the aforementioned discrete value. Then, the bit reducer 122 quantizes the correction data component (1, 1) by setting the binarized data of the correction data component (1, 1) to "0". Next, (i) the value (1.052=1.0058+0.046) obtained when a distribution value (0.046=0.106×7/16) obtained by distributing the difference (error component) (0.106) between the pre-processing data (0.999) and the post-processing data (0.893) of the correction data component (1, 1) by a predetermined weight is added to the correction data component (1, 2) of the first correction data, and (ii) the threshold value are compared (1.052>1.012) by the bit reducer 122. According to this result, the post-error diffusion correction data component (1, 2) is replaced with the round-up value (1.130) which is the aforementioned discrete value. Then, the bit reducer 122 quantizes the correction data component (1, 2) by setting the binarized data of the correction data component (1, 2) to "1". Next, (i) the value (0.9714) obtained when a distribution value (−0.054=−0.124×7/16) obtained by distributing the difference (−0.124) between the pre-processing data (1.0058) and the post-processing data (1.130) of the correction data component (1, 2) by a predetermined weight is added to the correction data component (1, 3) of the first correction data, and (ii) the threshold value are compared (0.9714<1.012) by the bit reducer 122. According to this result, the post-error diffusion correction data component (1, 3) is replaced with the round-down value (0.893) which is the aforementioned discrete value, and the correction data component (1, 3) is quantized by setting the binarized data of the correction data component (1, 3) to "0". Hereinafter, data up to the stage where the correction data component (1, 2) is diffused to the correction data components (2, 1), (2, 2), and (2, 3) of the surrounding pixels is shown in the correction data undergoing error diffusion in FIG. 5. Hereinafter, by performing error diffusion on all of the correction data components in the same manner, the binarized (quantized) second correction data as illustrated in FIG. 5 is generated. It should be noted that, in the correction data undergoing error diffusion in FIG. 5, values prior to error diffusion are shown for the correction data components (1, 4), (2, 4), and (3, 1) to (4, 4).

As described above, by applying error diffusion, the bit reducer 122 quantizes the correction data components (1, 1) to (4, 4) of the respective pixels included in the first correction data, based on the threshold value determined by the threshold value determiner 121, reconfigures the correction data component of each pixel included in the first correction data by propagating the error component during the quantization to the surrounding pixel of the pixel, and generates second correction data by performing bit reduction on the reconfigured correction data components of the first correction data. In the above-described example, the bit reducer 122 performs bit reduction by binarizing the correction data component of each pixel included in the first correction data, based on the threshold value.

Next, the data expander 132 reads and temporarily stores in the first memory the binarized (quantized) second correction data, and expands the second correction data to correction data (discrete value) having a number of bits larger than the number of bits of the second correction data, using the threshold value (=1.012) and the round-down value (=0.893) and the round-up value (=1.130). More specifically, as shown in the second correction data (after expansion) in FIG. 5, the data expander 132 expands the "0" which is the correction data component (1, 1) of the second correction data to the round-down value (=0.893), using the threshold value (=1.012) and the round-down value (=0.893). Furthermore, the data expander 132 expands the "1" which is correction data component (1, 2) of the second correction data to the round-up value (=1.130), using the threshold value (=1.012) and the round-up value (=1.130).

It should be noted that, although an example in which the second correction data is bit-reduced to 1 bit ("0" or "1") in this embodiment, the bit reduction is not limited to such example. In the case of bit-reducing the second correction data to 2 bits or more, the data expander 132 may expand the second correction data to correction data having a number of bits larger than the number of bits of the second correction data, using only one of the threshold value and the discrete value obtained by quantization the correction data component of the first correction data.

For example, assume that, when the second correction data is 3 bits, the threshold values are 0.910, 0.944, 0.978, 1.012, 1.045, 1.079, and 1.113, and the discrete values obtained by quantizing the first correction data (corresponding to the round-up value and the round-down value in the case where the second correction data is 2 bits) are 0.893 ("0"), 0.927 ("1"), 0.961 ("2"), 0.995 ("3"), 1.028 ("4"), 1.062 ("5"), 1.096 ("6"), and 1.130 ("7"). In this case, the data expander 132 can read and temporarily store in the first memory the respective correction data components of the second correction data that have been quantized to "0" to "7", and expand the respective correction data components of the second correction data to correction data components (discrete values) having a number of bits (4 bits or more) larger than the number of bits of the second correction data, using the aforementioned seven threshold values. For example, when the correction data component (1, 1) of the second correction data is "2", the expanded correction data component (1, 1) is determined to be a discrete value between the threshold value 0.944 and the threshold value 0.978, and 0.961 ("2") is calculated. Furthermore, when the correction data component (1, 2) of the second correction data is "0", the expanded correction data component (1, 2) takes on a discrete value smaller than the threshold 0.910, and according to 0.910−(0.944−0.910)/2 (half a threshold interval is subtracted from 0.910), 0.893 ("0") is calculated.

Furthermore, the data expander 132 can read and temporarily store in the first memory the respective correction data components of the second correction data that have been quantized to "0" to "7", and expand the respective correction data components of the second correction data to correction data components (discrete values) having a number of bits (4 bits or more) larger than the number of bits of the second correction data, using only the aforementioned seven discrete values. For example, when the correction data component (1, 1) of the second correction data is "1", the expanded data correction component (1, 1) can be calculated as the second largest 0.927 ("1"). Furthermore, when the correction data component (1, 2) of the second correction data is "5", the expanded data correction component (1, 2) can be calculated as the sixth largest 1.062 ("5").

Furthermore, the data expander 132 can read and temporarily store in the first memory the respective correction data components of the second correction data that have been quantized to "0" to "7", and expand the respective correction data components of the second correction data to correction data components (discrete values) having a number of bits (4 bits or more) larger than the number of bits of the second correction data, using only the largest value and the smallest value among the aforementioned seven discrete values. For example, it is possible to calculate the aforementioned seven discrete values using the aforementioned largest value and smallest value and the number of bits (3 bits) of the second correction data. Accordingly, for example, when the correction data component (1, 1) of the second correction data is "1", the expanded data correction component (1, 1) can be calculated as the second largest 0.927 ("1"). Furthermore, when the correction data component (1, 2) of the second correction data is "5", the expanded data correction component (1, 2) can be calculated as the sixth largest 1.062 ("5"). It should be noted that in the case of calculating the aforementioned seven discrete values using the aforementioned largest value and smallest value and the number of bits (3 bits) of the second correction data, aside from calculating by uniformly dividing the seven discrete values, it is also possible to set a weighted array or a random array, etc.

From FIG. 5, it can be understood that both the display images displayed according to the luminance signal corrected by the controller 10 according to this embodiment and the conventional controller 500 have largely reduced luminance unevenness compared to the display image according to the non-corrected luminance signal. The number of bits of the correction data is, however, different between the display image according to controller 10 according to this embodiment and the display image according to the conventional controller 500. Specifically, the second correction data resulting from the bit reduction by controller 10 according to this embodiment has a smaller data volume than the first correction data used by the conventional controller 500. As such, according to the display device 1 according to this embodiment, it is possible to reduce correction data volume and transfer rate while ensuring luminance correction accuracy even when the number of pixels of the display increases.

It should be noted that in display device 1 according to this embodiment, the transformer 12 and the corrector 13 may be implemented as an integrated circuit (IC) or, particularly, a large-scale integration (LSI) circuit which is an integrated circuit. Furthermore, the method of circuit integration may be implemented using a dedicated circuit or a general-purpose processor. A Field Programmable Gate Array (FPGA) which allows programming after LSI manufacturing or a reconfigurable processor which allows reconfiguration of the connections and settings of circuit cells inside the LSI may be used. In addition, if circuit integration technology that replaces LSI appears through advancement of semiconductor technology or other derived technology, that technology can naturally be used to carry out integration of the function blocks. Furthermore, the transformer 12 and the corrector 13 may be implemented as a program that causes the execution of encoding and decoding, or a non-transitory computer-readable recording medium on which the program is recorded, such as a flexible disc, hard disk, CD-ROM, MO, DVD, DVD-ROM, DVD-RAM, Blu-ray (BD (registered trademark)), or semiconductor memory. Naturally, such a program can be distributed via a recording medium such as a CD-ROM and a transmission medium such as the Internet.

[1.3 Display Device Correction Method]

Next, a method of correcting the display device 1 according to this embodiment will be described.

Figure 6:
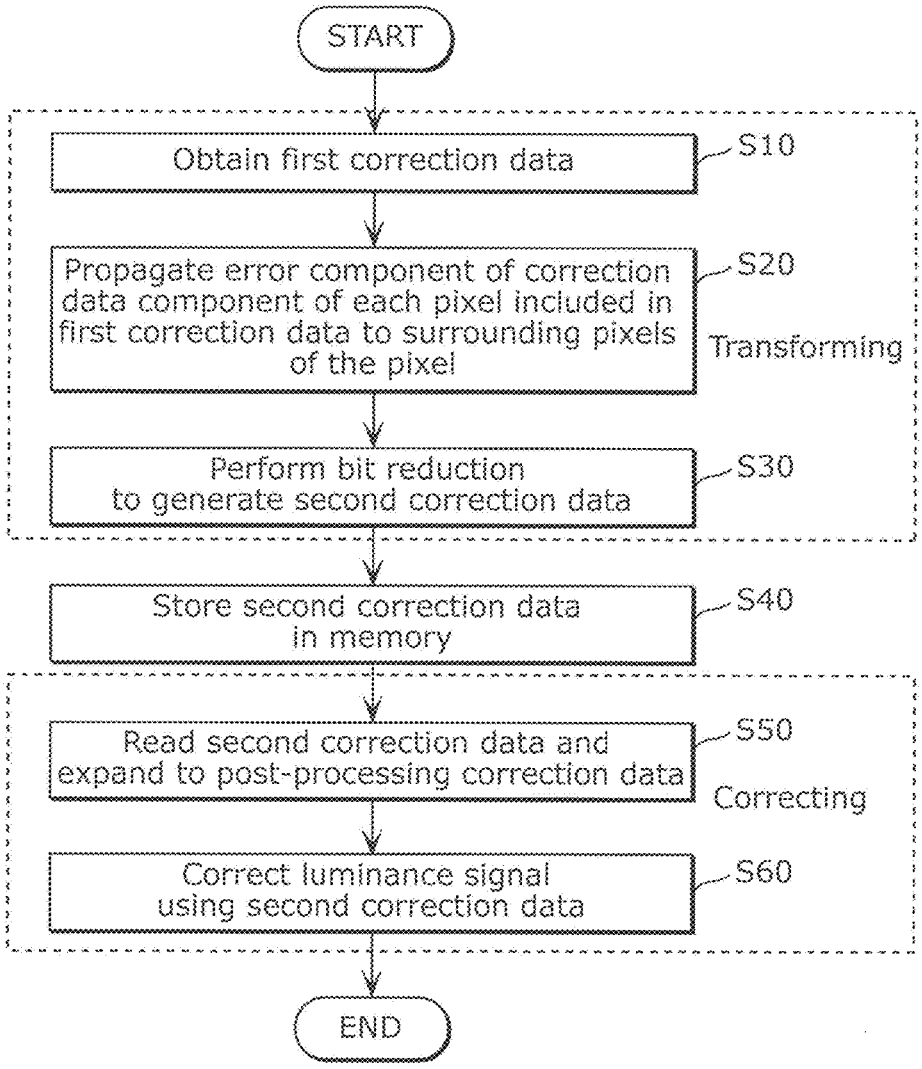
FIG. 6 is an operation flowchart describing a display device correction method according to Embodiment 1.

FIG. 6 is an operation flowchart describing the method of correcting the display device 1 according to Embodiment 1. FIG. 6 illustrates the processes up to when the controller 10 included in the display device 1 corrects the luminance signal using the second correction data. Hereinafter, the correction process will be described following FIG. 6.

First, the controller 10 obtains in advance the first correction data (pre-processing correction data) for correcting the luminance signal for causing the organic EL element 401 to emit light at a predetermined luminance (S10: Obtaining step). As already described, the first correction data (pre-processing correction data) includes, for example, the two parameters of the gain correction value and the offset correction value corresponding to the pixel 400.

Here, the method of obtaining first correction parameters will be exemplified.

Figure 7:
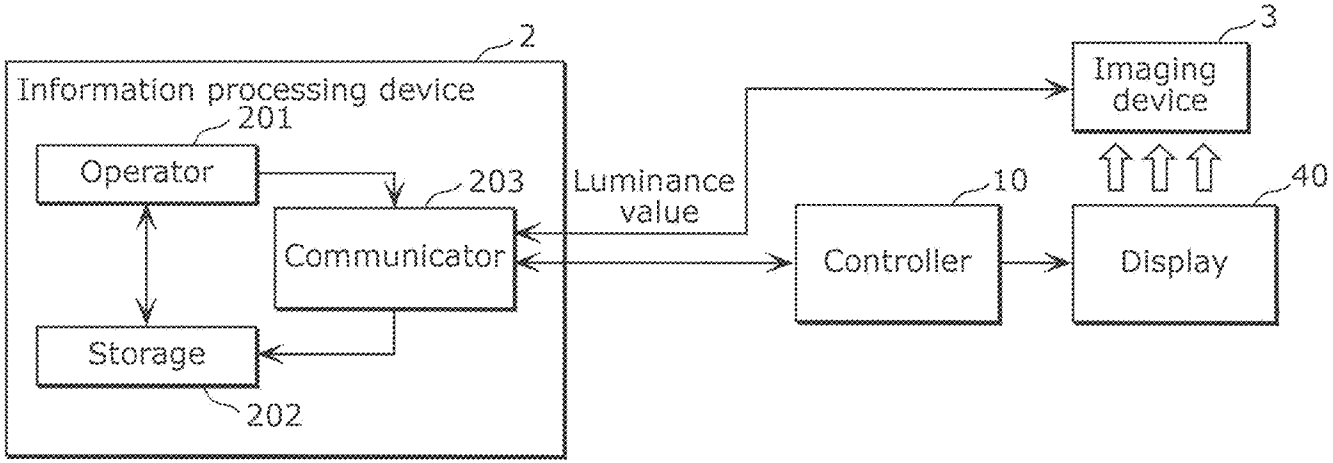
FIG. 7 is a block diagram of a measurement system for obtaining first correction data.

FIG. 7 is a block diagram of a measurement system for obtaining the first correction data. The measurement system illustrated in the figure includes an information processing device 2, an imaging device 3, the display 40, and the controller 10.

The information processing device 2 includes an operator 201, a storage 202, and a communicator 203, and has a function of controlling the processes up to the generation of the first correction parameters. A personal computer, for example, is applied as the information processing device 2.

The imaging device 3 captures an image of the display 40 according to a control signal from the communicator 203, and outputs the captured image data to the communicator 203. A CDD camera and a luminance meter are used as the imaging device 3.

The information processing device 2 outputs the control signal to the controller 10 of the display device 1 and the imaging device 3 via the communicator 203, obtains the measurement data from the controller 10 and the imaging device 3 and stores the measurement data in the storage 202, and calculates various characteristic values and parameters by performing arithmetic operations using the operator 201 based on the stored measurement data. It should be noted that a control circuit that is not provided inside the display device 1 may be used as the controller 10.

Specifically, the information processing device 2 controls the voltage value to be applied to a measurement pixel. The controller 10 applies the voltage value to the measurement pixel to cause the measurement pixel to emit light. The image device 3 measures the luminance value of the measurement pixel that has emitted light. The information processing device 2 receives the voltage value and the measured luminance value. The information processing device 2 changes the voltage value to be applied to the measurement pixel, performs the same control, and receives the different voltage value and the measured luminance value corresponding to such voltage value. By having the information processing device 2 repeat the above, the operator 201 calculates the voltage-luminance characteristic of each measurement pixel, compares the voltage-luminance characteristic and a voltage-luminance characteristic which serves as a reference, and calculates the correction parameters (gain correction value and offset correction value) of each measurement pixel.

The controller 10 receives the correction parameters calculated by the operator 201, as the first correction parameters, via the communicator 203.

According to the process described above, the controller 10 obtains in advance the first correction parameters for correcting the luminance signal.

Next, the controller 10 quantizes the correction data component corresponding to each pixel of the first correction data, and reconfigures the correction data component by propagating the error component during the quantization to the surrounding pixels of the pixel (S20).

Next, the controller 10 transforms the reconfigured correction data component of each pixel into second correction data by performing bit reduction (S30). Steps S20 and S30 are transforming steps performed by the transformer 12 of the controller 10.

Next, the controller 10 stores in advance the second correction data in the memory 11 included in the display device 1 (S40: Storing step).

Next, the controller 10 reads the second correction data from the memory 11, and expands the second data to correction data having a number of bits larger than the number of bits of the second correction data, using the threshold value serving as the reference value of the bit reduction in step S30 (S50).

It should be noted that the above-described expansion in step S50 is not an essential process. However, since the correction accuracy of the second correction data deteriorates as the bit reduction rate for the first correction data in step S30 increases, the above-described expansion may be performed in the case where the bit reduction rate is high.

Next, the controller 10 corrects the luminance signal using the second correction data (S60: Correcting step).

According to the method of correcting the display device 1 according to this embodiment described above, the luminance signal is corrected, not by using the first correction data (pre-processing correction data), but by using the second correction data that has undergone the processes in above-described steps S20 and S30. Furthermore, the second correction data generated by transforming the first correction data is stored in the memory 11. Because the second correction data results from the bit reduction of the first correction data, the second correction data has a smaller volume than the first correction data. Accordingly, as the resolution of the display 40 increases, the effect of reducing the capacity of the memory 11 for storing the second correction data that has been volume-reduced becomes prominent. With this, it becomes possible to reduce correction data volume and transfer rate while ensuring luminance correction accuracy.

It should be noted that in step S20, error diffusion may be used as the method for reconfiguring the correction data component corresponding to each pixel included in the first correction data by propagating the error component of the correction data component to the surrounding pixels of the pixel. By using error diffusion, luminance signal correction accuracy can be ensured. It should be noted that, aside from error diffusion, for example, dithering, represented by random dithering and pattern dithering, etc. may be applied.

Furthermore, when reconfiguring by propagating the error components of the correction data components corresponding to the respective pixels included in the first correction data, it is acceptable to quantize the error data components based on the threshold value determined according to the distribution state of the error data components included in the first correction data, and reconfigure the correction data components using the error components during the quantization.

Furthermore, the correction data components of each pixel that have been reconfigured by propagating the error components of the correction data components corresponding to the respective pixels included in the first correction data may be bit-reduced by binarization. In this case, the second correction data can be volume-minimized.

Embodiment 2

In Embodiment 1, a method of correcting display device 1 which includes obtaining first correction data, generating second correction data from the first correction data, and correcting the luminance signal using the second correction data is described. In contrast, in this embodiment, a method of correcting the display device 1 which includes generating second correction data from the first correction data, up to storing the second correction data in the memory 11 of the display device 1 will be described. In other words, whereas the method of correcting display device 1 according to Embodiment 1 which includes processing up to correcting the luminance signal using the second correction data, the method of correcting display device 1 according to this embodiment is different in including processing up to storing the second correction data in the memory 11. Hereinafter, description of elements that are the same as those of the display device 1 and the correction method thereof according to Embodiment 1 will be omitted, and description will be focused on the points of difference.

[2.1 Configuration of the Information Processing Device in the Manufacturing Process]

Figure 8:
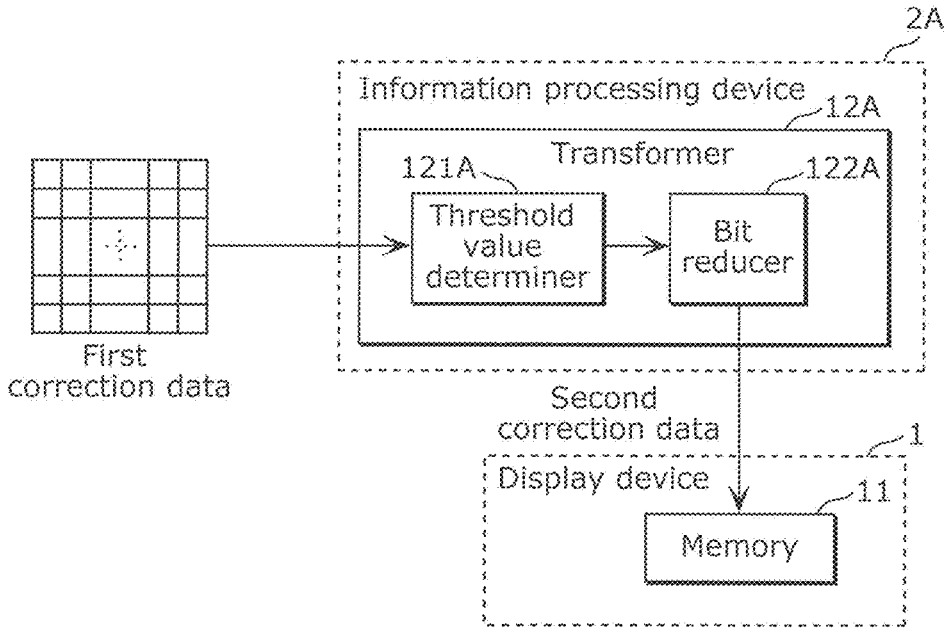
FIG. 8 is a block diagram illustrating the configuration of an information processing device that obtains second correction data in a manufacturing process.

FIG. 8 is a block diagram illustrating the configuration of an information processing device 2A that obtains second correction data in a manufacturing process. The information processing device 2A illustrated in the figure is used in the process of manufacturing display device 1, and includes a transformer 12A.

The transformer 12A includes a threshold value determiner 121A and a bit reducer 122A. The transformer 12A transforms first correction data into second correction data by (i) reconfiguring the correction data component of each pixel included in the first correction data by propagating, to the surrounding pixels of the pixel, the error component of the correction data component of the pixel included in the first correction data, and (ii) and performing bit reduction on the reconfigured correction data components of the first correction data.

The threshold value determiner 121A determines the threshold value to be used in the bit reduction by the subsequently-connected bit reducer 122A, based on the distribution of the correction data components included in the first correction data.

The bit reducer 122A quantizes the correction data component of each pixel included in the first correction data, based on the threshold value determined by the threshold value determiner 121, reconfigures the correction data component of each pixel included in the first correction data by propagating the error component generated in the quantization to the surrounding pixels of the pixel, and performs bit-reduction on the reconfigured correction data components of the first correction data to generate second correction data. More specifically, the bit reducer 122A bit-reduces the correction data component of each pixel included in the first correction data to a correction data component having a number of bits that is smaller than the number of bits of the correction data component before bit reduction, based on the threshold value.

It should be noted that the bit reducer 122A may binarize (convert to "0" or "1") the reconfigured correction data components of the first correction data, based on the threshold value determined by the threshold value determiner 121A. In this case, the correction data can be volume-minimized.

Error diffusion, for example, is used as a quantization method for reconfiguring the correction data component of each pixel included in the first correction data by propagating, to the surrounding pixels of the pixel, the error component of the correction data component of the pixel included in the first correction data. Aside from error diffusion, dithering, represented by random dithering and pattern dithering, etc. may be applied as the aforementioned method. By using error diffusion as the processing performed by the bit reducer 122A, luminance signal correction accuracy can be ensured.

It should be noted that the first correction data may be obtained by the information processing device 2 illustrated in FIG. 7 in Embodiment 1. At this time, the information processing device 2 according to Embodiment 1 and the information processing device 2A according to Embodiment 2 may be the same device combining the functions of both devices. In other words, the information processing device 2A according to this embodiment may include, aside from the transformer 12A, the operator 201, the storage 202, and the communicator 203. Furthermore, the first correction data may be provided to the information processing device 2A in advance.

[2.2 Display Device Manufacturing Method]

Figure 9:
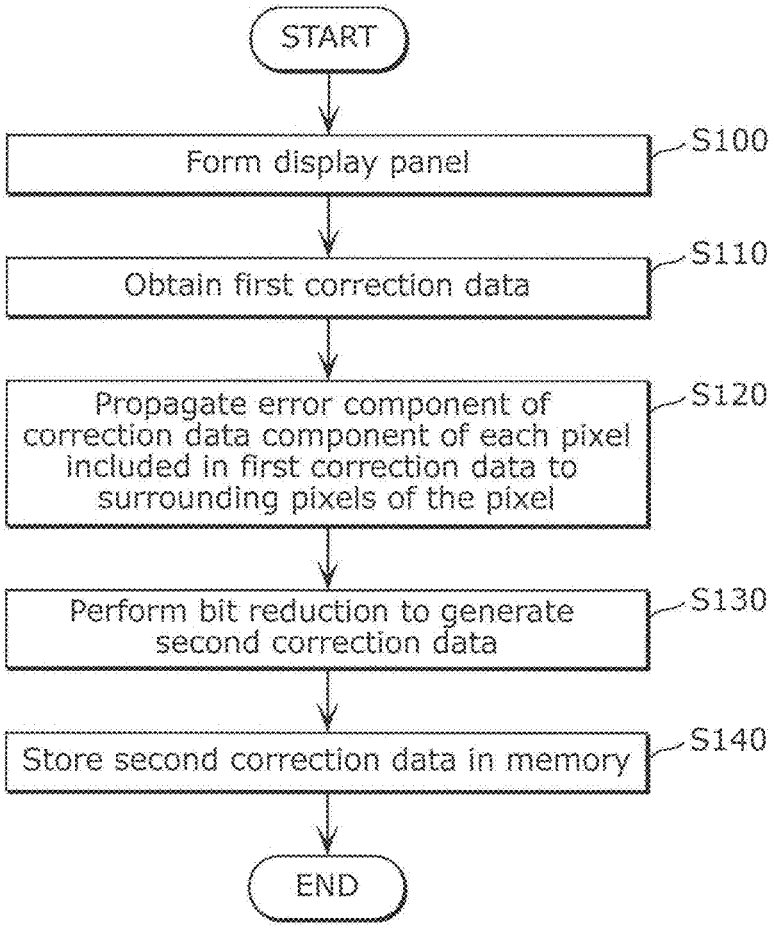
FIG. 9 is an operation flowchart describing a display device manufacturing method according to Embodiment 2.

FIG. 9 is an operation flowchart describing a method of manufacturing the display device 1 according to Embodiment 2. FIG. 9 illustrates the processes from forming the display panel included in display device 1 up to storing the second correction data in the memory. Hereinafter, the manufacturing process will be described following FIG. 9.

First, the display panel included in display device 1 is formed (S100: Display panel step). Hereinafter, the display panel forming process is exemplified. For example, a planarizing film comprising an organic material having an insulating property is formed on a substrate including circuit elements such as a TFT, after which an anode is formed on the planarizing film. Next, for example, a hole injection layer is formed on the anode. Next, a light-emitting layer is formed on the hole injection layer. Next, an electron injection layer is formed on the light-emitting layer. Next, a cathode is formed on the substrate on which the electron injection layer is formed. According to these processes, an organic EL element having the functions of a light-emitting element is formed. In addition, a thin-film sealing layer is formed on the cathode. Next, a sealing resin layer is applied to the surface of the thin-film sealing layer. Subsequently, a color filter is formed on the applied sealing resin layer. Next, an adhesion layer and a transparent substrate are disposed on the color filter. It should be noted that the thin-film sealing layer, the sealing resin layer, the adhesion layer, and the transparent substrate are equivalent to a protective layer. Lastly, heat or energy is added while applying pressure to the transparent substrate, from the upper surface downward, to cause the sealing resin layer to harden and cause adhesion between the transparent substrate, adhesion layer, and color filter and the thin-film sealing layer. According to the above-described forming process, the display panel is formed.

Next, the information processing device 2A obtains in advance the first correction data (pre-processing correction data) for correcting the luminance signal for causing the organic EL element 401 to emit light at a predetermined luminance (S110: Obtaining step). As already described, the first correction data (pre-processing correction data) includes, for example, the two parameters of the gain correction value and the offset correction value corresponding to the pixel 400. With regard to the method of obtaining the first correction parameter, the first correction parameter may be obtained by the information processing device 2 described using FIG. 7 in Embodiment 1, or the first correction parameter of a display panel manufactured in the same batch, for example, may be used.

Next, the information processing device 2A quantizes the correction data component corresponding to each pixel of the first correction data, and reconfigures the correction data component by propagating the error component during the quantization to the surrounding pixels of the pixel (S120).

Next, the information processing device 2A transforms the first correction data into second correction data by performing bit reduction on the reconfigured correction data component of each pixel (S130). Steps S120 and S130 are transforming steps performed by transformer 12A of information processing device 2A.

Next, the information processing device 2A stores in advance the second correction data in the memory 11 included in the display device 1 (S140: Storing step).

According to the method of correcting the display device 1 according to this embodiment described above, the first correction data (pre-processing correction data) is not stored in the memory 11, and second correction data which has undergone the processes in above-described steps S120 and S130 is stored in the memory 11. Because the second correction data results from the bit reduction of the first correction data, the second correction data has a smaller volume than the first correction data. Accordingly, as the resolution of the display 40 increases, the effect of reducing the capacity of the memory 11 for storing the second correction data that has been volume-reduced becomes prominent. With this, it becomes possible to reduce correction data volume and transfer rate while ensuring luminance correction accuracy.

It should be noted that in step S120, error diffusion may be used as the method for reconfiguring the correction data component corresponding to each pixel included in the first correction data by propagating the error component of the correction data component to the surrounding pixels of the pixel. By using error diffusion, luminance signal correction accuracy can be ensured. It should be noted that, aside from error diffusion, for example, dithering, represented by random dithering and pattern dithering, etc. may be applied.

Furthermore, when reconfiguring by propagating the error components of the correction data components corresponding to the respective pixels included in the first correction data, it is acceptable to quantize the error data components based on the threshold value determined according to the distribution state of the error data components included in the first correction data, and reconfigure the correction data components using the error components during the quantization.

Furthermore, in step S130, the correction data components of each pixel that have been reconfigured by propagating the error component of the correction data component corresponding to the pixel included in the first correction data may be bit-reduced by binarization. In this case, the second correction data can be volume-minimized.

Furthermore, the information processing device 2A may be provided inside the controller 10 included in the display device 1, and the controller 10 may obtain the second correction data and store the second correction data in the memory 11 in the manufacturing process.

Embodiment 3

In Embodiment 1, a method of correcting display device 1 which includes obtaining first correction data, generating second correction data from the first correction data, and correcting the luminance signal using the second correction data is described. In contrast, in this embodiment, a displaying method of the display device 1 including reading the second correction data, correcting the luminance signal using the second correction data, up to displaying according to the corrected luminance signal will be described. Specifically, whereas the method of manufacturing the display device 1 according to Embodiment 2 includes processes up to storing the second correction data in the memory 11, the display method of display device 1 according to this embodiment is different in including processes from reading the stored second correction data up to displaying. Hereinafter, description of elements that are the same as those of the display device 1 and the correction method thereof according to Embodiment 1 will be omitted, and description will be focused on the points of difference.

[3.1 Configuration of Controller]

Figure 10:
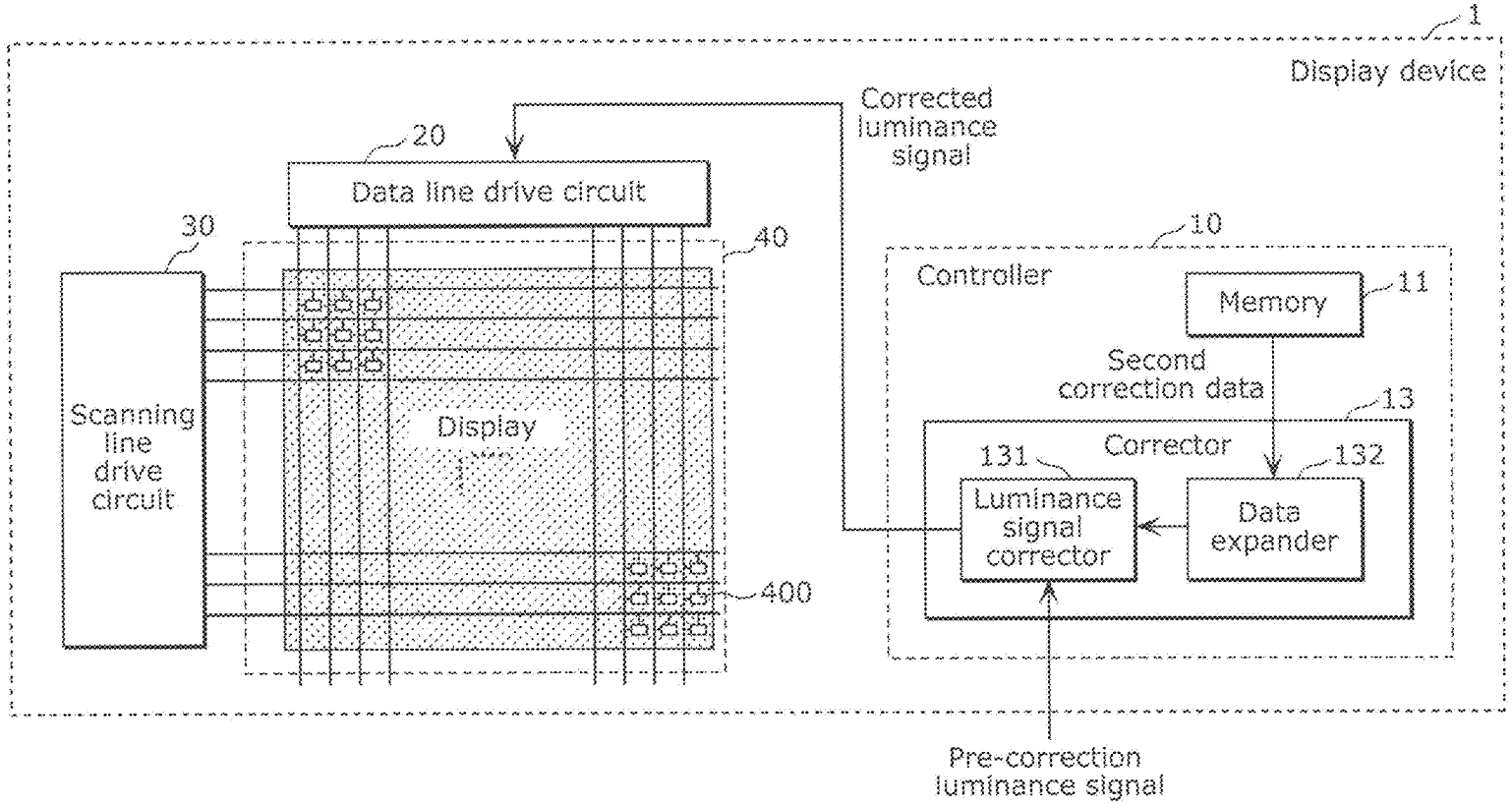
FIG. 10 is a block diagram illustrating the configuration of the controller that causes displaying on the display device, using the second correction data.

FIG. 10 is a block diagram illustrating the configuration of the controller 10 that causes the display device 1 to display, using the second correction data. The controller 10 illustrated in the figure includes the memory 11 and the corrector 13.

The corrector 13 corrects the luminance signal using the second correction data. The luminance signal is an electrical signal that is applied to a pixel to cause the light-emitting signal of the pixel to emit light. More specifically, in this embodiment, the luminance signal refers to the data voltage applied from the data line drive circuit 20 to the gate of the drive transistor 402 in order to cause the organic element 401 included in pixel 400 to emit light.

Here, in the display method according to this embodiment, the luminance signal is corrected, not by using the aforementioned first correction data (pre-processing correction data), but by using the post-processing correction data (second correction data) obtained by performing volume-reduction on the pre-processing correction data (first correction data). Because the second correction data results from the bit reduction of the first correction data, the second correction data has a smaller volume than the first correction data.

Accordingly, as the resolution of the display 40 increases, the effect of reducing the capacity of the memory 11 for storing the second correction data that has been volume-reduced than the first correction data becomes prominent. From the point of view of a recording medium that does not require excessively large capacity and long service life, a nonvolatile memory such as a flash memory can be applied as the memory 11.

The corrector 13 includes a data expander 132 and a luminance signal corrector 131.

The data expander 132 includes, for example, a nonvolatile first memory such as a DRAM, and an operation circuit. The data expander 132 reads the second correction data from the memory 11 and temporarily stores the second correction data in the first memory. Here, at least one of threshold value determined by the threshold value determiner 121 and a discrete value from the quantization of the first correction data is stored in a second memory, represented by a SRAM, provided inside (or outside) the first memory. The operation circuit may expand the second correction data stored in the first memory to correction data (discrete value) having a larger number of bits than the number of bits of the second correction data stored in the memory 11, using the at least one of the threshold value determined by the threshold value determiner 121 and a discrete value from the quantization of the first correction data that is stored in the second memory. In other words, the corrector 13 expands the second correction data to data with a larger number of bits than the second correction data, using the at least one of the threshold value and the discrete value, and correcting the luminance signal using the correction data obtained by bit-compressing the first correction data. It should be noted that in the controller 10 according to this embodiment, the data expander 132 is not an essential structural component.

However, since the correction accuracy of the second correction data deteriorates as the bit reduction rate for the first correction data increases, the data expander 132 may be provided in the case where the bit reduction rate is high.

The luminance signal corrector 131 corrects the luminance signal corresponding to the pixel 400 using the second correction data expanded by the data expander 132. An example of the luminance signal correction by the luminance signal corrector 131 is shown below.

Out of the second correction data (gain correction value, offset correction value), the luminance signal corrector 131 multiplies (or divides) the data voltage corresponding to the pre-correction luminance signal by the gain correction value, and adds (or subtracts) the offset correction value to the product, and outputs the result to the data line drive circuit 20. With this, it becomes possible to reduce correction data volume and transfer rate while ensuring luminance correction accuracy.

[3.2 Display Device Display Method]

Figure 11:
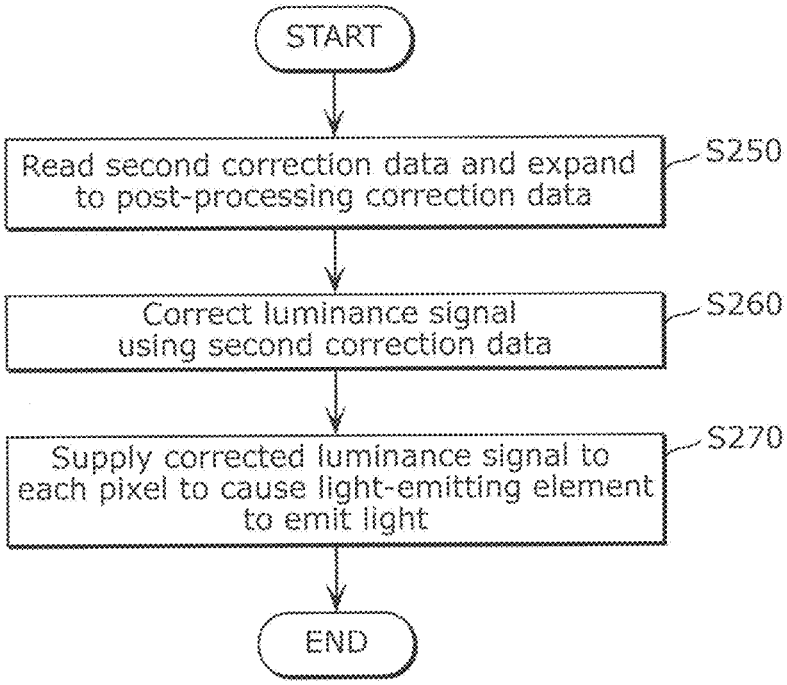
FIG. 11 is an operation flowchart describing a display device display method according to Embodiment 3.

FIG. 11 is an operation flowchart describing the display method of the display panel 1 according to Embodiment 3. FIG. 11 illustrates processes from reading the second correction data, correcting the luminance signal, up to causing displaying, performed by the controller 10 included in the display device 1. Hereinafter, the correction process will be described following FIG. 11.

First, controller 10 reads the second correction data from the memory 11, and expands the second correction data to a correction data having a number of bits that is larger than the number of bits of the second correction data, using at least one of the threshold value serving as the reference value for bit-reduction and the discrete value obtained from quantizing the first correction data (S250).

It should be noted that the above-described expansion in step S25 is not an essential process. However, since the correction accuracy of the second correction data deteriorates as the bit reduction rate for the first correction data increases, the above-described expansion may be performed in the case where the bit reduction rate is high.

Next, the controller 10 corrects the luminance signal using the second correction data (S260: Correcting step).

Lastly, the controller 10 supplies the luminance signal that was corrected in the correction step to each pixel 400, causes the organic EL elements 401 to emit light according to the luminance signal, to thereby display on the display device 1 (S270: Display step).

According to the display method of the display device 1 according to this embodiment described above, the luminance signal is corrected, not by using the first correction data (pre-processing correction data), but by using the second correction data obtained after bit-reduction. Furthermore, the second correction data generated by transforming the first correction data is stored in the memory 11. Because the second correction data results from the bit reduction of the first correction data, the second correction data has a smaller volume than the first correction data. Accordingly, as the resolution of the display 40 increases, the effect of reducing the capacity of the memory 11 for storing the second correction data that has been volume-reduced becomes prominent. With this, it becomes possible to reduce correction data volume and transfer rate while ensuring luminance correction accuracy.

Other Embodiments

Although Embodiments 1 to 3 have been described thus far, the display device, the display device correction method, the display device manufacturing method, and the display device display method according to one or more aspects of the present invention are not limited to the above-described embodiments. Modifications that can be obtained by executing various modifications to the foregoing embodiments that are conceivable to a person of ordinary skill in the art without departing from the essence of the present invention, and various devices internally equipped with the display device according to the present invention are included in the present invention.

Figure 12:
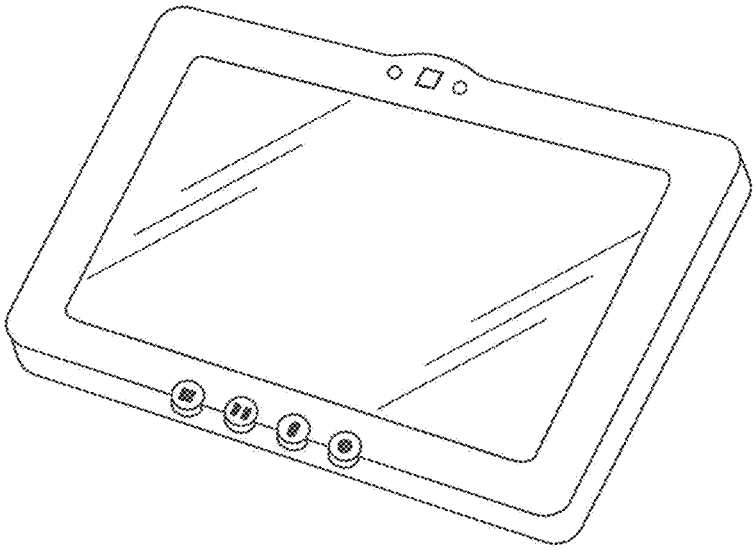
FIG. 12 is an external view of a tablet terminal internally equipped with the display device according to any one of Embodiments 1 to 3.

For example, the display device, the display device correction method, the display device manufacturing method, and the display device display method according to Embodiments 1 to 3 may be applied to a tablet terminal such as that illustrated in FIG. 12. According to the display device, the display device correction method, the display device manufacturing method, and the display device display method according to the present invention, a low-cost, small-sized, and high-definition tablet terminal including a display in which luminance unevenness is suppressed can be realized.

It should be noted that although the case where an image is displayed on the display 40 according to a luminance signal generated based on an external video signal in the foregoing embodiments, the luminance signal is not limited to such. The luminance signal for causing pixels to emit light is generated not only according to an external video signal, but also according to various signals for displaying a still picture or video.

Furthermore, the first correction data is not limited to being generated at the time of manufacturing the display device 1. Furthermore, the second correction data is not limited to being stored in the memory 11 at the time of manufacturing the display device 1. Even during a display operation or non-display operation after the manufacturing of the display device 1, the first correction data may be updated, and the second correction data may be updated based on the updated first correction data and stored.

Furthermore, the light-emitting element included in each pixel may be a light-emitting element comprising a current-driven or voltage-driven organic material.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present invention is particularly useful in an organic EL flat panel display internally equipped with a display panel using organic EL elements, and is applicable for use as a display device of a small-sized high-definition display for which uniform image quality is demanded.

The invention claimed is:

1. A display device display method for a display device, including pixels which are arranged in a matrix and have light-emitting elements that emit light according to a luminance signal, the display device display method comprising:

correcting the luminance signal using second correction data obtained by obtaining in advance first correction data, which includes correction data components each corresponding to a different one of the pixels and is for correcting the luminance signal, and transforming the first correction data into the second correction data, by (i) reconfiguring the correction data components by propagating an error component of each of the correction data components to surrounding pixels of a corresponding one of the pixels, and (ii) performing bit reduction on the correction data components that have been reconfigured; and displaying on the display device by supplying the luminance signal corrected in the correcting to the pixels to cause the light-emitting elements to emit light according to the luminance signal, wherein, in the transforming, the first correction data is transformed into the second correction data by performing error diffusion on the correction data components included in the first correction data, and performing the bit reduction on the correction data components on which the error diffusion has been performed, wherein, in the transforming, the correction data components included in the first correction data are propagated to the surrounding pixels based on threshold value data calculated in advance, and wherein, in the correcting, each of correction data components included in the second correction data is expanded to data having a larger number of bits than the second correction data, using at least one of the threshold value data and a discrete value obtained by quantizing the first correction data, and the luminance signal is corrected using the second correction data that has been expanded.

2. The display device display method according to claim 1, wherein, in the transforming, the first correction data is transformed into the second correction data by binarizing the correction data components that have been reconfigured by propagating each of the correction data components to the surrounding pixels of the corresponding one of the pixels.

3. A display device, including pixels that are arranged in a matrix and have light-emitting elements that emit light according to a luminance signal, the display device comprising:

a transformer that transforms first correction data, which includes correction data components each corresponding to a different one of the pixels and is for correcting the luminance signal, into second correction data by (i) reconfiguring the correction data components by propagating an error component of each of the correction data components to surrounding pixels of a corresponding one of the pixels and (ii) performing bit reduction on the correction data components that have been reconfigured; and a corrector that corrects the luminance signal using the second correction data, wherein the transformer transforms the first correction data into the second correction data by performing error diffusion on the correction data components included in the first correction data, and performing the bit reduction on the correction data components on which the error diffusion has been performed, wherein, when the transformer transforms, the correction data components included in the first correction data are propagated to the surrounding pixels based on threshold value data calculated in advance, and wherein, when the corrector corrects, each of correction data components included in the second correction data is expanded to data having a larger number of bits than the second correction data, using at least one of the threshold value data and a discrete value obtained by quantizing the first correction data, and the luminance signal is corrected using the second correction data that has been expanded.

4. The display device according to claim 3, further comprising:

a memory in which the second correction data is stored, wherein the corrector reads the second correction data stored in the memory, and corrects the luminance signal using the second correction data.

5. The display device correction method according to claim 3, wherein the transformer transforms the first correction data into the second correction data by binarizing the correction data components that have been reconfigured by propagating the error component of each of the correction data components to the surrounding pixels of the corresponding one of the pixels.

* * * * *